US005575517A

United States Patent [19]

Thomas

[11] Patent Number: 5,575,517

[45] Date of Patent: Nov. 19, 1996

[54] PORTABLE, HAND-OPERATED HOIST

[76] Inventor: Bruce A. Thomas, 2029 S. Elms Rd., Swartz Creek, Mich. 48473

[21] Appl. No.: 327,098

[22] Filed: Oct. 21, 1994

[51] Int. Cl.[6] ..... B65H 75/40; B66C 1/10

[52] U.S. Cl. ..... 294/1.1; 294/82.11; 242/381.3

[58] Field of Search ..... 294/1.1, 19.2, 294/66.1, 82.1, 82.11; 242/381.3, 381.6, 385.4, 916; 224/162

[56] References Cited

U.S. PATENT DOCUMENTS

| | | | |
|---|---|---|---|
| 3,141,696 | 7/1964 | Nau | 294/66.1 |
| 4,243,350 | 1/1981 | Hall | 242/381.3 |
| 4,402,472 | 9/1983 | Burtscher | 242/381.3 |
| 5,388,877 | 2/1995 | Wenk | 294/1.1 |

*Primary Examiner*—Dean Kramer
*Attorney, Agent, or Firm*—James C. McLaughlin

[57] ABSTRACT

A portable, hand-operated hoist that is particularly suited for use by persons afield in woods or rough terrain is disclosed. In its preferred embodiment, a housing contains a length of fabric ribbon urged to remain in the housing by a spring, an orifice for through communication of the ribbon, and a locking device (of over-center type) for selectively preventing movement of the ribbon. An end of the ribbon is outside of the housing, attached to a hook, and prevented from entering the housing by the size of the hook. A holder is on the outside of the housing for detachably retaining the hook when it is not in use. A clip is also on the outside of the housing to facilitate detachably attaching the hoist to the user's apparel.

1 Claim, 4 Drawing Sheets

PORTABLE, HAND-OPERATED HOIST

TECHNICAL FIELD OF THE INVENTION

The technical field of the present invention is that of portable, hand-operated hoists that are particularly suited for use by persons afield in woods or rough terrain. More particularly, the technical field of the present invention includes hoists that are light and small enough to be carried by a person with a negligible effort and with little risk of snagging, that stow their line within a housing when it is not in use, that have selective and locking means for paying out only as much line as is desired when in use, and that have automatic means for retrieving their line into a housing after use.

BACKGROUND INFORMATION

Persons afield, especially solo hunters, experience difficulty in safely and conveniently hoisting their bow, camera or other impedimenta up into (or down from) elevated places. Such places include shooting platforms. A person can only carry so much while his or her hands are occupied with an activity like climbing or scaling. Many such activities take place within a score or so feet of the ground. A need exists for a convenient and safe device for hoisting and lowering relatively light items to and from a height. Such a device should be readily accessible, not be prone to snag on objects while being carried, should have means for automatically retrieving its line after use or when desired, and should be able to be adjustable to payout only the amount of line desired.

U.S. design patent U.S. Pat. No. D318,941 might show a hoist. The design patent's drawings suggest a folding crank that might be used manually to retrieve a line and suggest an unstowable hook. The line shown appears to be cylindrical wire or string. This device appears not to be able automatically to retrieve its line, appears to be prone to snagging on objects while being carried because of its unstowable hook, and appears not to have means for paying out only the amount of line needed.

An object of the present invention is a hoist that is designed to be able to be used to hoist relatively light items while being easy and convenient to carry. More particular objects of the present invention are a hoist that allows one to use only as much line as is needed, a hoist that has self contained automatic means for retrieving and stowing line after use or when desired, and a hoist that is not prone to snag on objects while being carried.

SUMMARY OF THE INVENTION

The foregoing and other objects and advantages are achieved with the apparatus disclosed below. The preferred embodiment of the apparatus of the present invention comprises a housing (with a clip for facilitating attachment to a person's apparel) containing a coiled, strong, fabric ribbon urged to remain within the housing by a spring effectively attached to one end of the ribbon and yet a ribbon able to be retracted from the housing for use. The housing also includes a selective locking means for holding the ribbon at a desired position. The end of the ribbon able to be retracted from the housing has attached a specialized hook that may be stowed in conjunction with a holder attached to the housing, thereby greatly reducing the chance of snagging. The attached hook also serves to maintain one end of the ribbon outside of the housing. This apparatus shall be referred to as the hoist.

A typical user clips the hoist to his or her belt, or other piece of apparel, before going afield so that the hoist is readily accessible. While the hoist is latent, the specialized hook is stowed and thus unlikely to snag on a passing object. When arriving at a tree, vantage-point, or other place that the user desires to scale and to bring equipment to, the user may un-clip the housing and, in any case, un-stows the hook. The user then attaches the hook (or alternatively, attaches a loop of the ribbon and the hook) to the equipment to be hoisted effectively forming a sling. The user then may pull from the housing somewhat more ribbon than the distance to be scaled, locks the ribbon in place, clips the housing back on his or her apparel (if not already done), and ascends. Alternatively, the user may merely clip the housing on his or her apparel and ascend, allowing the ribbon to extend from the housing. On reaching the height and with his or her hands being free, the user grasps the ribbon and pulls the equipment up by hand, disconnects the ribbon and hook from the equipment, disengages the lock, and the ribbon is automatically retrieved into the housing (or, alteratively, merely allows the ribbon to return to the housing on its own while pulling up the equipment). These steps are essentially reversed to lower equipment.

DETAILED DESCRIPTION OF THE INVENTION AND ITS PREFERRED EMBODIMENT

Figure 1:
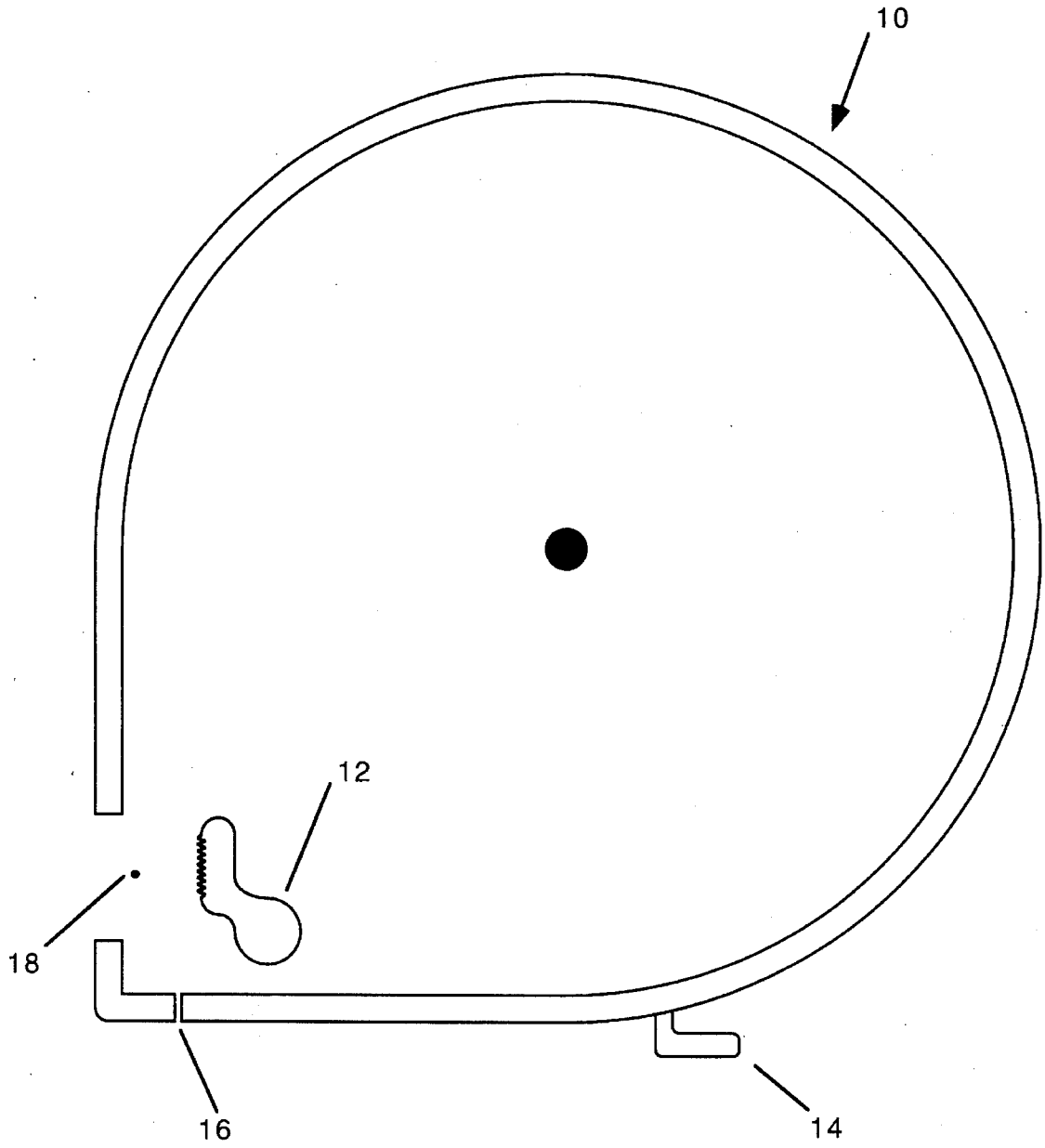
FIG. 1 is a side, inside view of the housing and its major parts.

The preferred embodiment of the present invention is illustrated by FIGS. 1, 2, 3, and 4. FIG. 1 shows that housing 10 contains an anvil 12 facing lock-pivot 18 and to the side of ribbon-slot 16. The face of anvil 12 is preferably striated to increase its effective coefficient of friction and, as is discussed below, to cooperate with lock 20. The face of anvil 12 is capable of slight deflection when subjected to a force. The outside of housing 10 contains hook-holder 14. Hook-holder 14 is further described below. Housing 10 is preferably molded from plastic and in two symmetrical, mating pieces that are sealed to each other.

Figure 2:
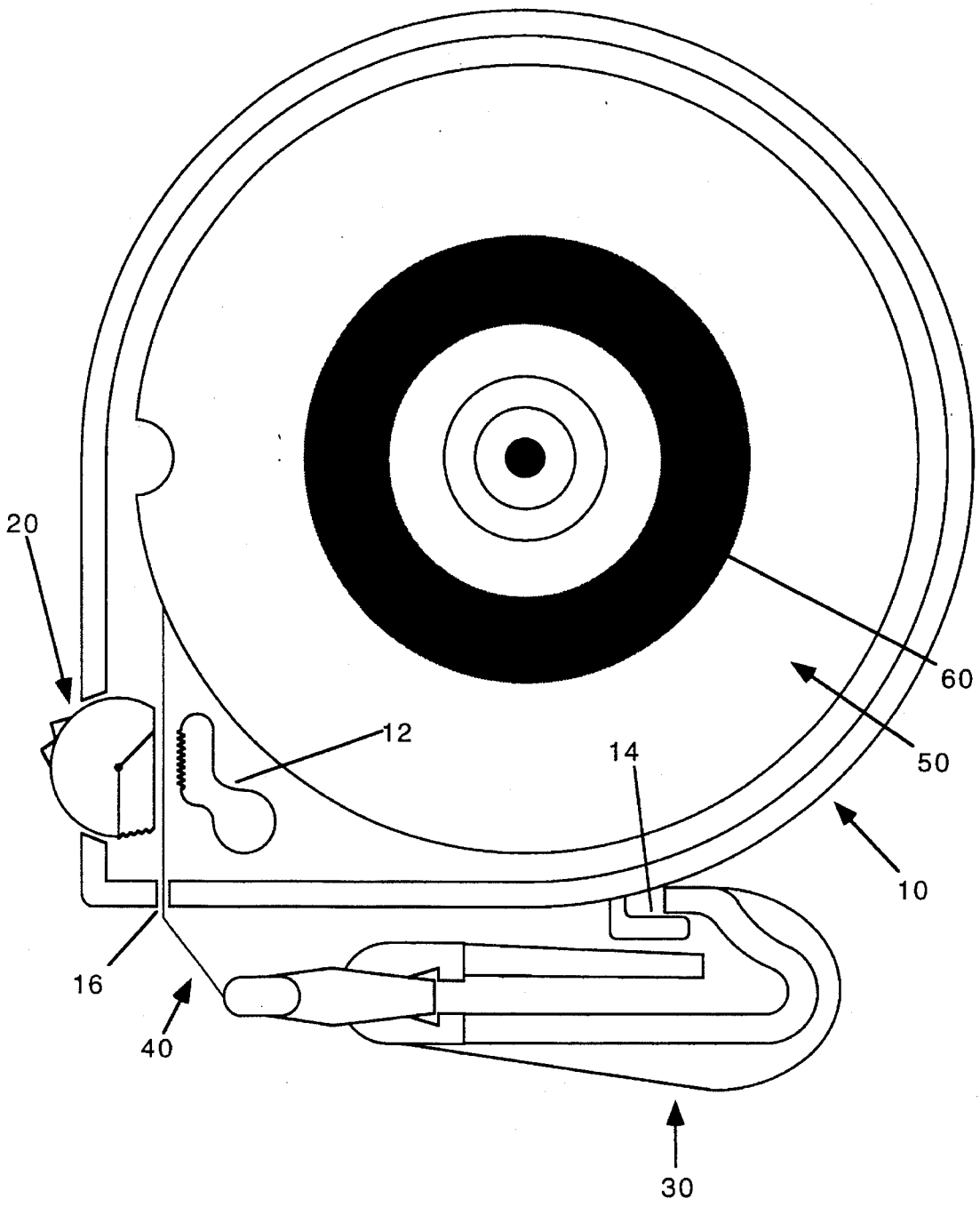
FIG. 2 is the same as FIG. 1 with the addition of the spring, spool, ribbon, lock, and hook.

FIG. 2 shows the major parts of the preferred embodiment of the present invention assembled into housing 10. A cylindrical spool 50 is placed in the center of housing 10 so that it may rotate. The spool 50 contains a central, coaxially placed, spiraled spring 60 and has about 25 feet of ribbon 40 wound around its outer extent. Spring 60 and ribbon 40 are placed and attached so that as ribbon 40 is pulled from spool 50 and out of ribbon-slot 16, tension is increased in spring 60 tending to return ribbon 40 into housing 10. Ribbon 40 is run past the face of anvil 12, out of ribbon-slot 16, and attached to hook 30. Hook 30 is too large to pass through ribbon-slot 16 and its hooking end is shaped to be able detachably to attach to hook-holder 14. Hook-holder 14 is a recess formed on the outside of housing 10 that is just large enough to hold the tip of hook 30 and thus be used to stow hook 30. Hook-holder 14 is placed just far enough from ribbon-slot 16 so that stowed hook 30 will be snuggled next to housing 10 by tension on ribbon 40. The means for locking ribbon 40 is an asymmetrical, rotatable member mounted off to one side of ribbon-slot 16 such that ribbon 40 is between anvil 12 and the member, and such that the member is rotatable from outside of housing 10 and may be rotated so as to pinch ribbon 40 against anvil 12. In the preferred embodiment, lock 20 approximates a cylinder with a flat face that is able to rotate about its major axis. Preferably one or more longitudinal knurls are formed approximately opposite to the flat side. These longitudinal knurls may facilitate manual rotation of lock 20. Adjacent to the flat face, a plurality of longitudinal striae are formed having a spacing approximately the same as the aforementioned striae on the face of anvil 12. Lock 20 is placed over lock-pivot 18 such that it is able to rotate. Slight rotation of lock 20 pinches ribbon 40 between it and anvil 12 in an over-center action, thus preventing movement of ribbon 40. A locking action is effected by the cooperation of the striae on lock 20 and on anvil 12. When lowering an object, it has been observed that, if ribbon 40 is inadvertently released, the lock 20 tends to lock automatically.

In the preferred embodiment, ribbon 40 is fabric. Fabric is preferred over metal tape because the user is much less likely to be cut when using fabric, and fabric is preferred over wire of any kind both because of fabric's greater safety and because fabric is easier to coil in a satisfactory manner. The fabric of ribbon 40 stretches when pulled, rendering it most unsuited to being used to bear measurement indicia and to being used to measure length. A sown loop is formed with the fabric around divider 52 (further described below) to attach one end of ribbon 40 within housing 10. This method of attachment will not inadvertently decouple as will an interlocking tang type of attachment.

Ribbon-slot 16 is preferably a narrow slot. Not only does ribbon-slot 16 serve to block the passage of hook 30, but it is so narrow that the entry of most foreign matter into the housing is precluded. Ribbon-slot 16 also serves to align ribbon 40 with spool 50.

Figure 3:
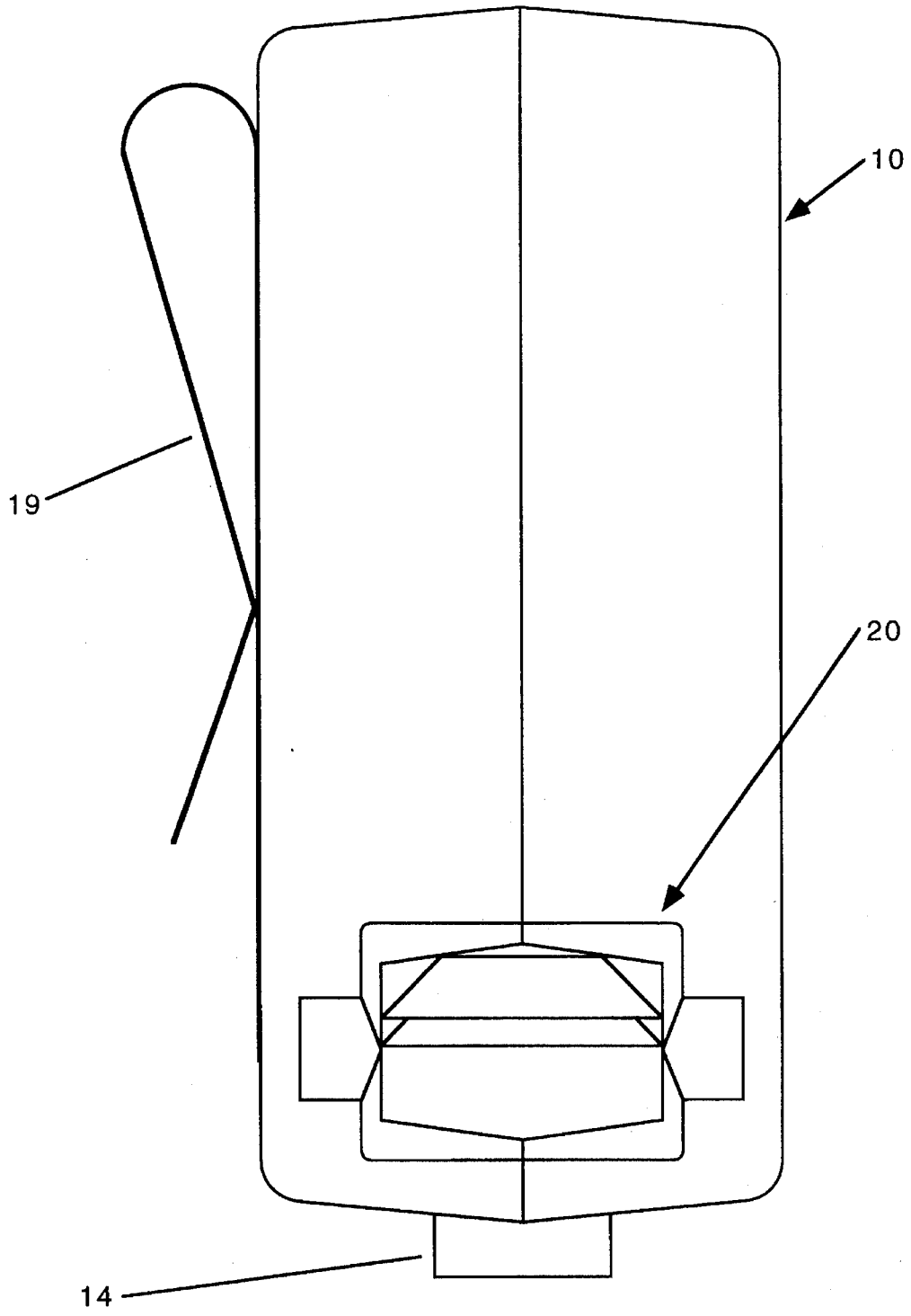
FIG. 3 is a front, outside view of the front of the invention showing the clip, lock, and hook-holder.

FIG. 3 shows the outside of the present invention absent ribbon 40 and hook 30. The outside face of lock 20 and the back of hook-holder 14 are visible. Also visible is clip 19 attached to the outside of housing 10, preferably made of spring steel and used to clip the present invention to a garment or the like so as to facilitate carrying the device. Not only is it expected that the user will use clip 19 to facilitate carrying the device, but it is also expected that hook 30 will be detachably retained in hook-holder 14 so that hook 30 does not tend to snag on objects while the device is being carried. FIG. 3 also makes evident how housing 10 may be made of two symmetrical pieces.

Figure 4:
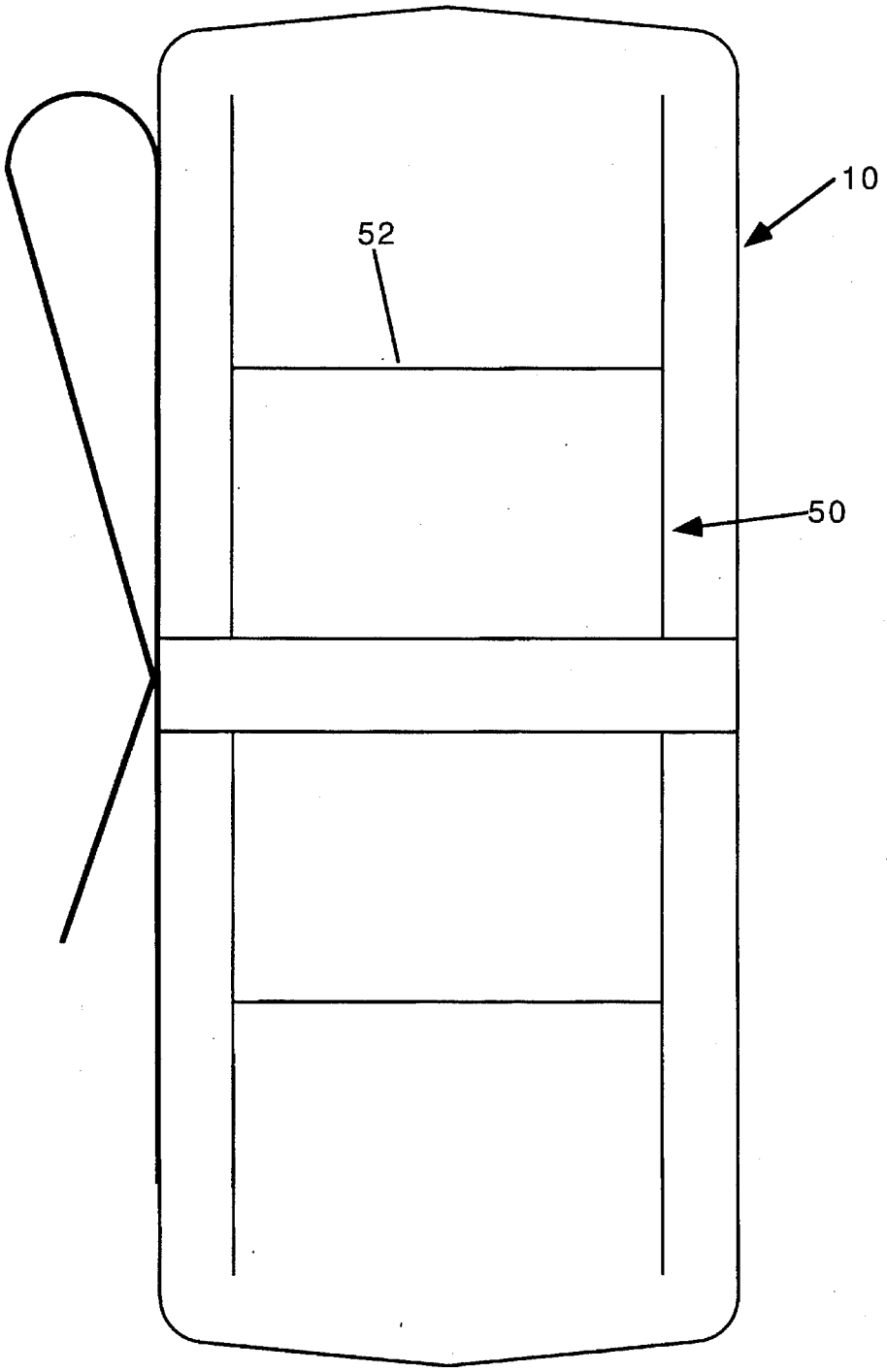
FIG. 4 is a front, cross-section view that shows the construction of the spool.

FIG. 4 shows a cross section of the present invention without spring 60 and ribbon 40. Cylindrical divider 52 is coaxial to spool 50 and separates spring 60 from ribbon 40.

The method of using the preferred embodiment of the present invention is expected to comprise something like the following steps: The user releases lock 20, stows hook 30 in hook-holder 14 (this may require pulling a short length of ribbon 40 from housing 10), locks lock 20, and clips the hoist to his or her belt (using clip 19). These preliminary steps insure that the hoist is readily available and is unlikely to snag on any object while being carried. When the user is ready to ascend and desires to use the hoist, lock 20 is released, hook 30 is un-stowed from hook-holder 14, and a length of ribbon 40 is pulled from housing 10 and is attached to or around the object to be hoisted (using hook 30 or ribbon 40 or both). The user then, alternatively, may pull a total length of ribbon 40 from housing 10 that is somewhat longer than the height to be climbed, lock lock 20, and ascend, or the user may merely clip the housing 10 on his or her apparel and ascend, allowing the ribbon 40 to extend from the housing 10. After ascending, the user grasps ribbon 40 with his or her hands, pulls up the attached equipment, detaches ribbon 40 or hook 30 from the equipment, and releases lock 20 allowing ribbon 40 to be retracted into housing 10 (or, alteratively, merely allows the ribbon 40 to return to the housing 10 on its own). These steps are essentially reversed to lower equipment.

The preferred embodiment of the present invention has been described in detail. The descriptions are illustrative and not restrictive.

I claim:

1. A hoist comprising:

a length of ribbon with a first end and a second end;

a hook attached to said second end;

a housing large enough to hold said ribbon and having an orifice large enough for through communication of said ribbon but too small for through communication of said hook, wherein said ribbon has its said first end retained within said housing, communicates through said orifice, and has said second end outside of said housing;

a holding means attached to said housing for detachably retaining said hook, said holding means comprising a recess on the outside of said housing placed just far enough from said orifice that a retained hook will be snuggled next to said housing; and a locking means cooperating with said ribbon and said housing for selectively preventing movement of said ribbon.

* * * * *